US007192323B2

(12) United States Patent
Smith

(10) Patent No.: US 7,192,323 B2
(45) Date of Patent: Mar. 20, 2007

(54) STABILIZER DEVICE

(75) Inventor: Don Andrew Smith, Caloundra (AU)

(73) Assignee: Smithkins Holding PtyLtd ACN. (AU)

( * ) Notice: Subject to any disclaimer, the term of this patent is extended or adjusted under 35 U.S.C. 154(b) by 0 days.

(21) Appl. No.: 10/512,278

(22) PCT Filed: Jan. 29, 2003

(86) PCT No.: PCT/AU03/00078

§ 371 (c)(1),
(2), (4) Date: Oct. 22, 2004

(87) PCT Pub. No.: WO03/086851

PCT Pub. Date: Oct. 23, 2003

(65) Prior Publication Data

US 2005/0199173 A1 Sep. 15, 2005

(30) Foreign Application Priority Data

Apr. 11, 2002 (AU) ..... PS1677

(51) Int. Cl.
*B63B 35/79* (2006.01)
*B63B 3/38* (2006.01)
*B63B 39/06* (2006.01)

(52) U.S. Cl. ..... 441/79; 114/140

(58) Field of Classification Search ..... 114/271, 114/274–284, 39.15, 126, 129, 138–140, 114/152, 163, 39.24; D12/309; 441/65, 441/74, 79

See application file for complete search history.

(56) References Cited

U.S. PATENT DOCUMENTS 2,341,159 A * 2/1944 Neklutin ..... 114/274
2,984,197 A * 5/1961 Bader ..... 114/282
2,991,747 A * 7/1961 Bader et al. ..... 114/282
3,604,384 A * 9/1971 Coles ..... 114/274
3,651,775 A * 3/1972 Kock ..... 114/274
4,782,779 A 11/1988 Heyerman
6,439,148 B1 * 8/2002 Lang ..... 114/278
6,748,893 B1 * 6/2004 Jorde et al. ..... 114/274
6,901,873 B1 * 6/2005 Lang et al. ..... 114/274

FOREIGN PATENT DOCUMENTS

FR 2724905 A1 3/1996
GB 2177353 1/1987
WO WO 99/22986 A1 5/1999
WO WO 01/50590 A1 8/2001

* cited by examiner

*Primary Examiner*—Ajay Vasudeva
(74) *Attorney, Agent, or Firm*—Brooks Kushman P.C.

(57) ABSTRACT

A low profile stabiliser device for attaching to the under surface of a watercraft, typically a surfboard or a boat, including in combination a plurality of stubby keel members joined by one or more transverse members spaced from the bottom surface of the watercraft, the keel members comprising a vertical foremost keel member positioned along the longitudinal centerline of the watercraft trailing keel members on either side of the foremost keel member, the trailing keel members leaning at an angle with respect to the foremost keel member and trailing in staggered formation outwardly towards the rear and sides of the watercraft, the staggered formation adapted to substantially reduce or remove interference to the sideways release of water from each keel member by an adjacent keel member, wherein in operation, one or more of the leaning keel members can be made to approach a vertical position as the watercraft heels over in a turning maneuver.

25 Claims, 10 Drawing Sheets

80
82
84
86
88
90

82
84
86
88
90

100
102
104
106
108
110
112
114
116

120
122
124
126
128

122
124

122
123
124
125
126
127
128
121

130
131
132
133
134
135
136
137
140

151
152
153
154
155
156
157
160

165
166
167
168
169
170

STABILIZER DEVICE

FIELD OF THE INVENTION

This invention relates to watercraft in particular but not limited to a stabilizer device for attachment to surf craft, typically surfboards or boats.

BACKGROUND OF THE INVENTION

Prior art fin systems for attaching to surfboards and sailboards are well known. Fins can be permanently fixed to the bottom of a surfboard or can be part of a removal fin system wherein the fins are fixed with short screws or are wedged in fin boxes.

Where fins are to be permanently fitted to a surfboard, the fin must be positioned accurately on the bottom of the surfboard and must be fibreglassed into the material of the surfboard. This requires shaping and sanding of the fin base to achieve a smooth contour with the under surface of the surfboard that is labour intensive.

Removable fin systems such as those marketed by FCS™ and O'Fish' L™, Red X™ have the disadvantage of having to be mounted by cutting into the surfboard to attach a fin box or fin holders resulting in a weakening of the region around the fins. A limitation of current fin systems is also that they can cause damage to the entire surfboard when the fins are forcibly broken off such as in rough sea conditions or by a collision with a coral reef or other hard objects. A further disadvantage of current fin systems is that the blade size and shape of the fins can cause serious injury to surfers and other swimmers. Such injuries are prevalent in difficult to control situations such as in rough or big surf or in surfboard collisions or wipeouts. As modern surfboards are also tethered by leg ropes, fins of a recoiling surfboard can also be highly dangerous to the rider and other swimmers around him/her. Present solutions to damaged glassed in fins which is also common occurrence when surfboards are transported or damaged in the surf result in a manufacturer having to retain the surfboard to effect repairs which are both time consuming and labour intensive. In addition, if the repaired or replaced fin is not precisely positioned during the repairs, the performance of the surfboard will also be affected. Replacement of individual fins is an expensive process.

OBJECT OF THE INVENTION

It is therefore an object of the present invention to seek to ameliorate one or more of the disadvantages of prior art fin systems for surfboards and other watercraft or to at least to provide the public with a useful choice.

STATEMENT OF THE INVENTION

According to one aspect, the invention resides in a low profile stabilizer device for attaching to the under surface of a watercraft, typically a surfboard or a sailboard, or boat including in combination, a plurality of stubby keel members joined by one or more transverse members spaced from the bottom surface of the watercraft, the keel members comprising a vertical foremost keel member positioned along the longitudinal centerline of the watercraft, with trailing keel members on either side of the foremost keel member, the trailing keel members leaning at an angle with respect to the foremost keel member and trailing in staggered formation outwardly towards the rear and sides of the watercraft, the staggered formation adapted to substantially reduce or remove interference to the sideways release of water from each keel member by an adjacent keel member, wherein in operation, one or more of the leaning keel members can be made to approach a vertical position as the watercraft heels over in a turning maneuver.

Preferably the trailing keel members on either side of the foremost keel member lean away from the foremost keel member. Alternately and less preferably, the trailing keel members lean toward the foremost keel member.

Preferably leading edges of the trailing keel members and the transverse members are slightly inclined towards the nose or front of the watercraft to provide positive angles attack adapted to induce hydrodynamic lift as the watercraft moves through water.

Preferably the keel members are staggered in a "U", "V" or "W" formation across the under surface of the watercraft. Correspondingly, the transverse members joining the keel members are also of a "U", "V" or "W" configuration.

Preferably all keel members are joined by a single transverse member.

Preferably all keel members and transverse members have aerodynamic or hydrodynamic cross sections and function as hydrofoils.

Typically, the stubby keel members are foil sections of a low aspect ratio, whereas, the transverse members are foil sections of a high aspect ratio.

Preferably the directional stability and hydrodynamic lift imparted by the keel members and by the transverse members contribute to an overall reduction in turbulence and drag of the watercraft moving through the water.

Suitably, a surfboard fitted with the stabilizer can be steered by altering the weight distribution of the rider thereby altering the angles of attack of both the keel members and the transverse members of the stabilizer.

Preferably the stabilizer is of a unitary construction wherein keel members and transverse members are manufactured typically by molding, in one piece and can be adapted to replace the fins on a surfboard or sailboard.

Preferably the stabilizer is molded from a resilient but flexible plastic, rubber or equivalent material to reduce or prevent injury when fitted to a surfboard, sailboard or surfski when it is fitted to a boat, the stabilizer can be made of other materials such as brass and stainless steel.

Preferably a surfboard, sailboard or surfski fitted with the stabilizer device instead of fins can be maneuvered and controlled in the same manner as if the surfboard, sailboard or surfski were fitted conventional fins.

Preferably the transverse members lie in a horizontal plane that is tangential or parallel to the under surface, however, the transverse members can be angled or inclined in a dihedral or a reversed dihedral or anhedral angle with respect to the under surface of the watercraft.

In addition, the transverse members can also have end tips that are at a different angle to the main portion of the transverse members.

Preferably the stabilizer is attached to the under surface of a watercraft by means of stainless steel screws or other secure fastening means. In the alternative, the stabilizer device may include vertical projection members for attachment to conventional fin boxes and/or plugs designed for removable fins.

Preferably the stabilizer position is adjustable on the watercraft typically inclusion of slots in cooperation with the screws or other fastening means to allow fore and aft movement.

In a more preferred version, the positions of the transverse members and keel members can be individually adjusted with respect to one another and also with respect to their location on the under surface of the watercraft.

Preferably the transverse members and the keel members together with the under surface form one or more channels adapted to channel water along the under surface thereby reducing turbulence and drag.

In one preferred form, one or more of the keel members is of a greater height than the other keel member and/or the transverse numbers extend past the outer most keel members.

BRIEF DESCRIPTION OF THE DRAWINGS

In order that the present invention be more readily understood and put into practical effect, reference will now be made to the accompanying illustrations wherein.

DETAILED DESCRIPTION OF THE DRAWINGS

EXAMPLE 1

Figure 1:
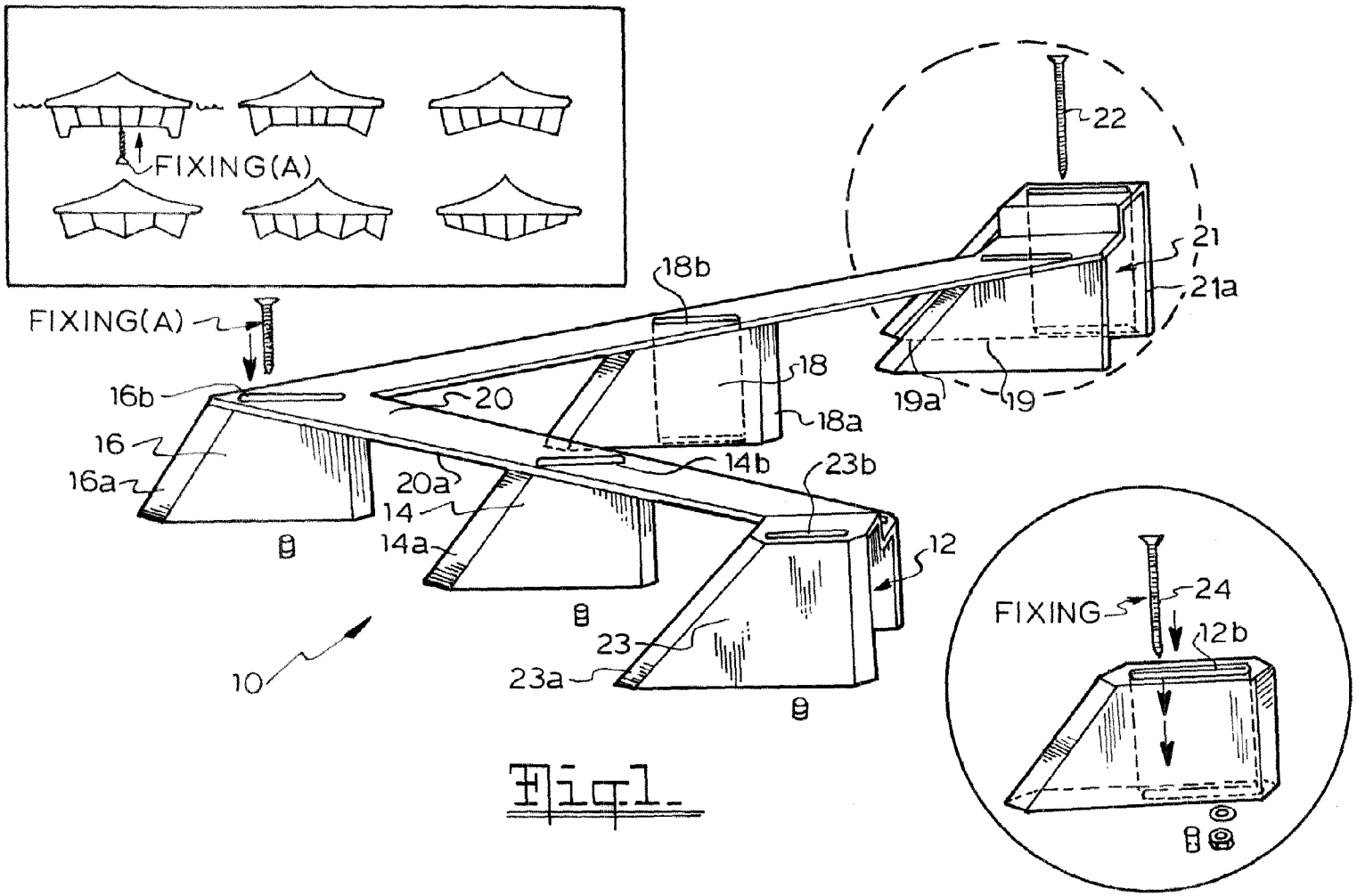
FIG. 1 shows a perspective view of the invention according to Example 1.

FIG. 1 shows a stabilizer device of the invention according to Example 1. The stabilizer device 10 is shown having a number of keel members 12, 14, 16, 18, 19, 21, 23 that are joined by a transverse member 20 in a "V" shaped configuration with a foremost keel member. The leading edges 12, 16 and the leading edge of 20 of the keel members and the transverse member 20 are beveled to generate hydrodynamic lift. In this example, the keel members are lined substantially parallel to the longitudinal axis of the watercraft (not shown) and it is preferred that they lean at an angle away from the foremost keel member. In this version, the transverse member is shown substantially parallel to the under surface of a surfboard, however, it is possible that the transverse member can also be mounted at a slight downwards incline towards the nose or front of the surfboard in order to provide a positive angle of attack adapted to induce hydrodynamic lift as the surfboard accelerates through the water.

Although in this version the transverse members and the keel members are shown with substantial rectangular cross sections, preferably in a production version they will be aerodynamic or hydrodynamic in cross section which will further enhance their functions as hydrofoils. As shown, the keel members are foil sections having a relatively low aspect ratio wherein the transverse member is a foil section of a relatively high aspect ratio.

The surfboard or sailboard to which the stabilizer device will be fitted can be steered by altering the weight distribution on the surfboard or sailboard as the rider applies pressure to different regions of the deck of the watercraft.

The stabilizer device shown is a prototype version and is manufactured out of perspex, however, it is envisaged that a production model will be manufactured out of recycled plastics or hard rubber in the interest of reducing or removing the danger of injury to the rider. For larger watercraft such as boats, the stabilizer device can be made of firmer materials such as brass or stainless steel.

The keel members are shown having slots (broken lines) 12*b*, 14*b*, 16*b*, 18*b* wherein they can be fastened to the under surface of a surfboard by means of stainless steel screws 22, 24. The slots in the keel members enabling the stabilizer device to move in a fore and aft direction with respect to the under surface of the surfboard. Although not shown in this example, the transverse member can have upwardly tilting wing tips that may extend past the outermost keel member. As will be seen, the transverse members and the keel members will form partial channels with the under surface of the surfboards through which water can flow with a reduction in turbulence and hence overall drag. The staggered formation of the trailing keel members trailing away to the rear and sides of the watercraft also substantially reduces or removes the interference to the sideways release of water from each keel member by an adjacent keel member.

EXAMPLE 2

Figures 2, 2D, 3, 3C, 3D, 4, 4C, 4D:
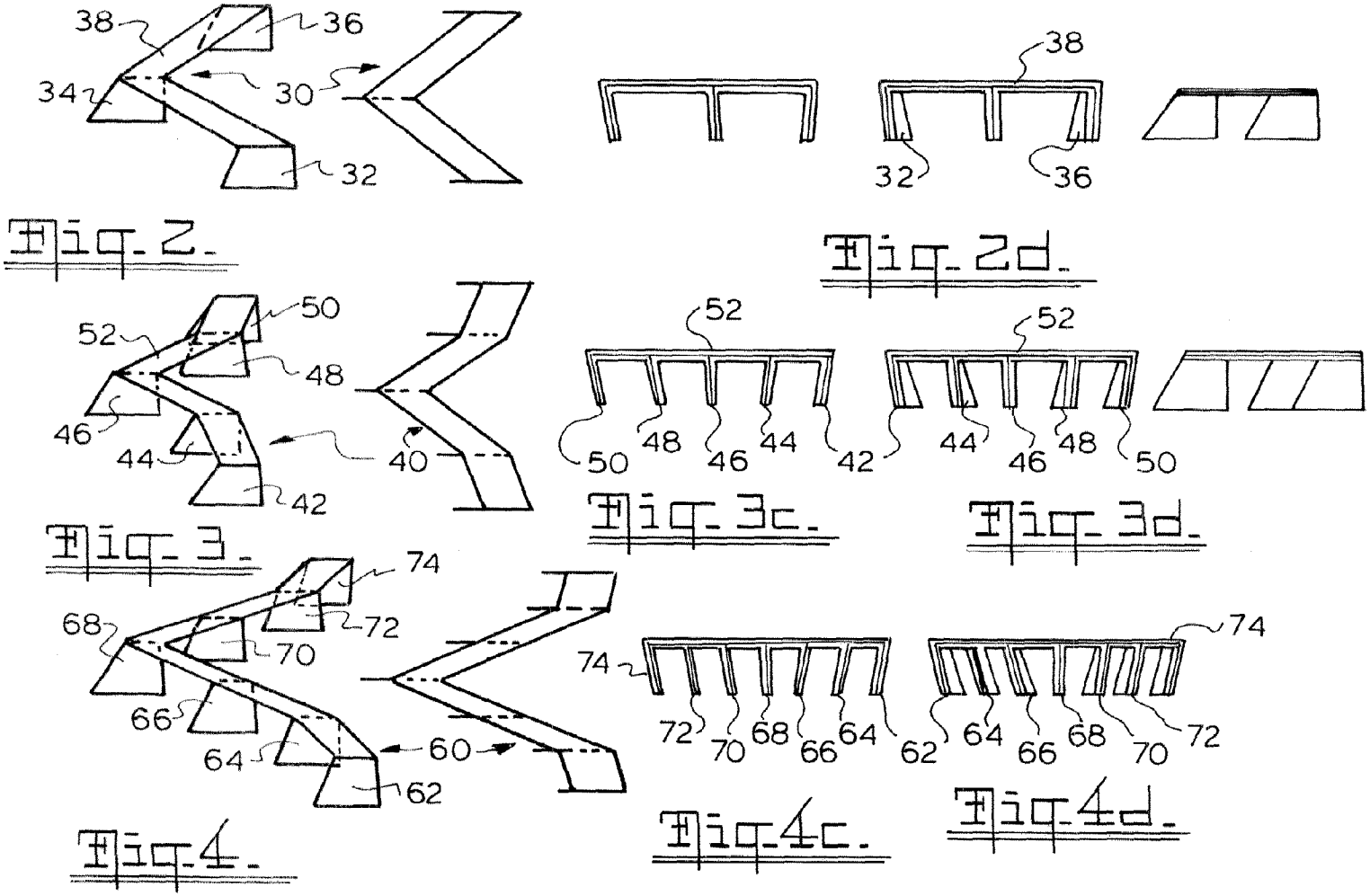
FIGS. 2 to 15 show different versions of the invention according to Examples 2 to 15.

FIG. 2 shows another preferred embodiment of the invention according to Example 2. The stabilizer device 30 is shown with three keel members 32, 34, 36 in a "V" shaped formation with the corresponding transverse member 38 also in a "V" shaped configuration. The end elevation shows a configuration wherein all the keel members are aligned parallel to a longitudinal axis of the watercraft.

FIG. 2*d* shows the stabilizer device wherein the outermost trailing keel members 32, 36 are angled slightly inwards towards the front of the watercraft and the transverse member 38 is shown inclined at a reversed dihedral or anhedral angle with respect to the under surface of the watercraft.

EXAMPLE 3

FIG. 3 shows a further preferred embodiment of the invention according to Example 3. In this variant 40, there are five keel members 42, 44, 46, 48, 50 supporting a modified "V" shaped transverse member 52.

The front elevation shown by FIG. 3*c* shows the transverse member 52 in a horizontal plane wherein the keel members 42, 44, 46, 48, 50 are aligned parallel to a longitudinal axis of a watercraft.

FIG. 3*d* shows the outermost keel members 42, 44, 48, 50 angled slightly towards the nose of the watercraft and wherein the transverse member 52 is shown dipping towards the nose of the watercraft at a positive angle of attack. The positive angle of attack is to induce and contribute hydrodynamic lift as the waterdraft speeds through the water.

EXAMPLE 4

FIG. 4 shows a further variation 60 of the invention according to Example 1 wherein the seven keel members 62–74 are arranged in a "V" shaped formation.

FIG. 4*c* is a front elevation showing a rear view of the stabilizer device wherein the keel members 62–74 are all aligned substantially parallel to a longitudinal axis of the watercraft.

FIG. 4*d* shows a rear elevation wherein the outer keel members 62–66 and 70–74 are gradually angled towards the front or nose of the watercraft.

EXAMPLE 5

Figures 5, 5B, 6, 7, 7C, 7D:
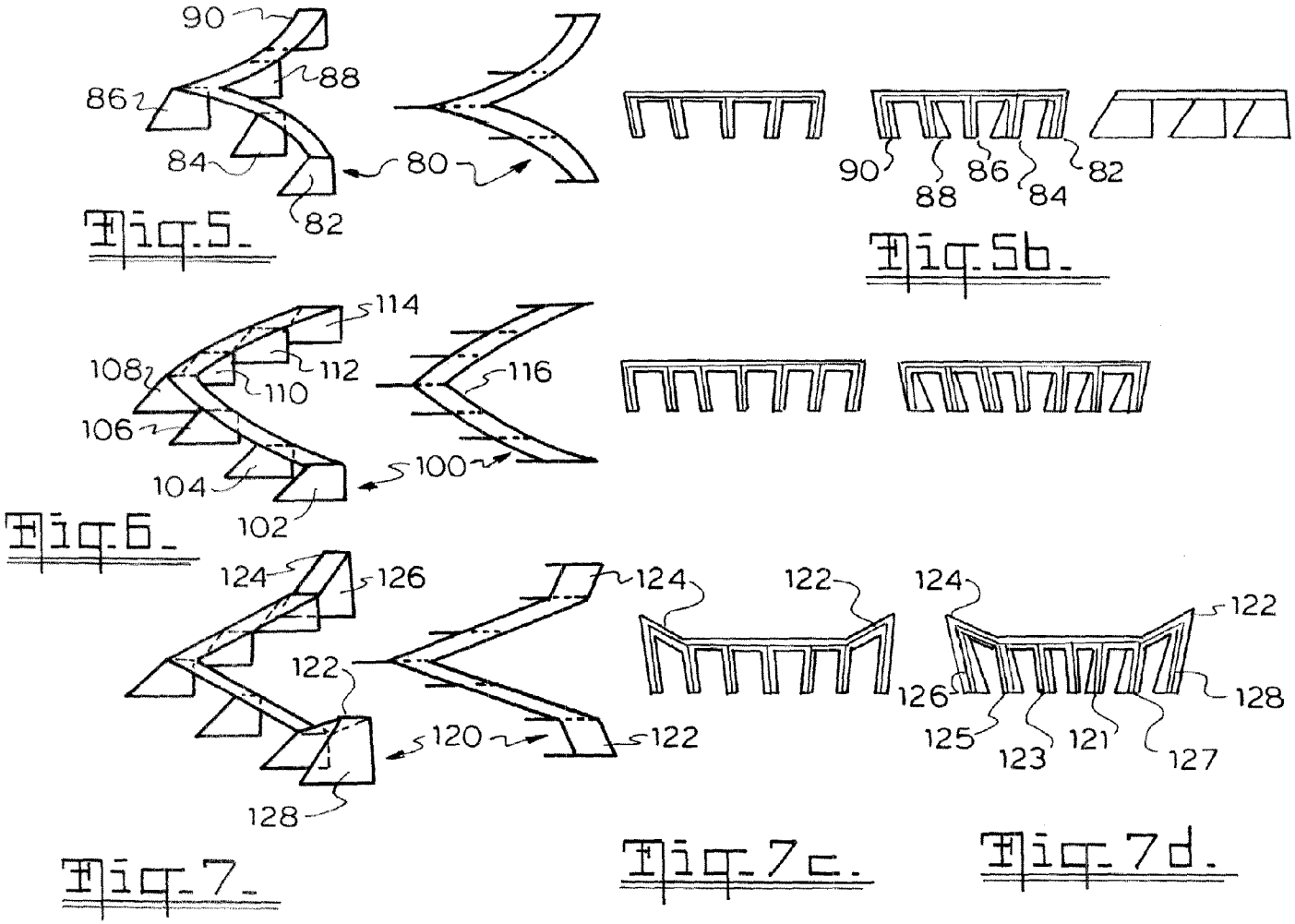

FIG. 5 shows a further variation of the stabilizer device 80 according to Example 5. In this example, there are five keel members 82–90 arranged in a curved "V" shaped formation.

Similarly, FIG. 5*d* shows a rear elevation wherein the outer keel members 82, 84 and 88, 90 are gradually inclined towards the nose or front of the watercraft.

EXAMPLE 6

FIG. 6 shows a further example 100 of the invention according to Example 6. In this example, there are seven keel members 102–114 arranged in a "U" shaped formation wherein the transverse member 116 is correspondingly also configured in a "U" shape.

EXAMPLE 7

FIG. 7 shows a further variation 120 of the invention according to Example 7. In this example, the stabilizer device has raised wing or end tips 122, 124 wherein the outermost keel members 126, 128 are of a greater height than the inner keel members.

Shown in the end elevation of FIG. 7*c* are keel members that are arranged substantially parallel to the longitudinal axis of the watercraft.

FIG. 7*d* shows a rear elevation wherein the outer keel members 121, 127, 128 and 123, 125, 126 are gradually inclined towards the nose of the watercraft.

EXAMPLE 8

Figures 8, 8A, 8B, 8C, 8D, 9, 9A, 9B, 9C, 9D:
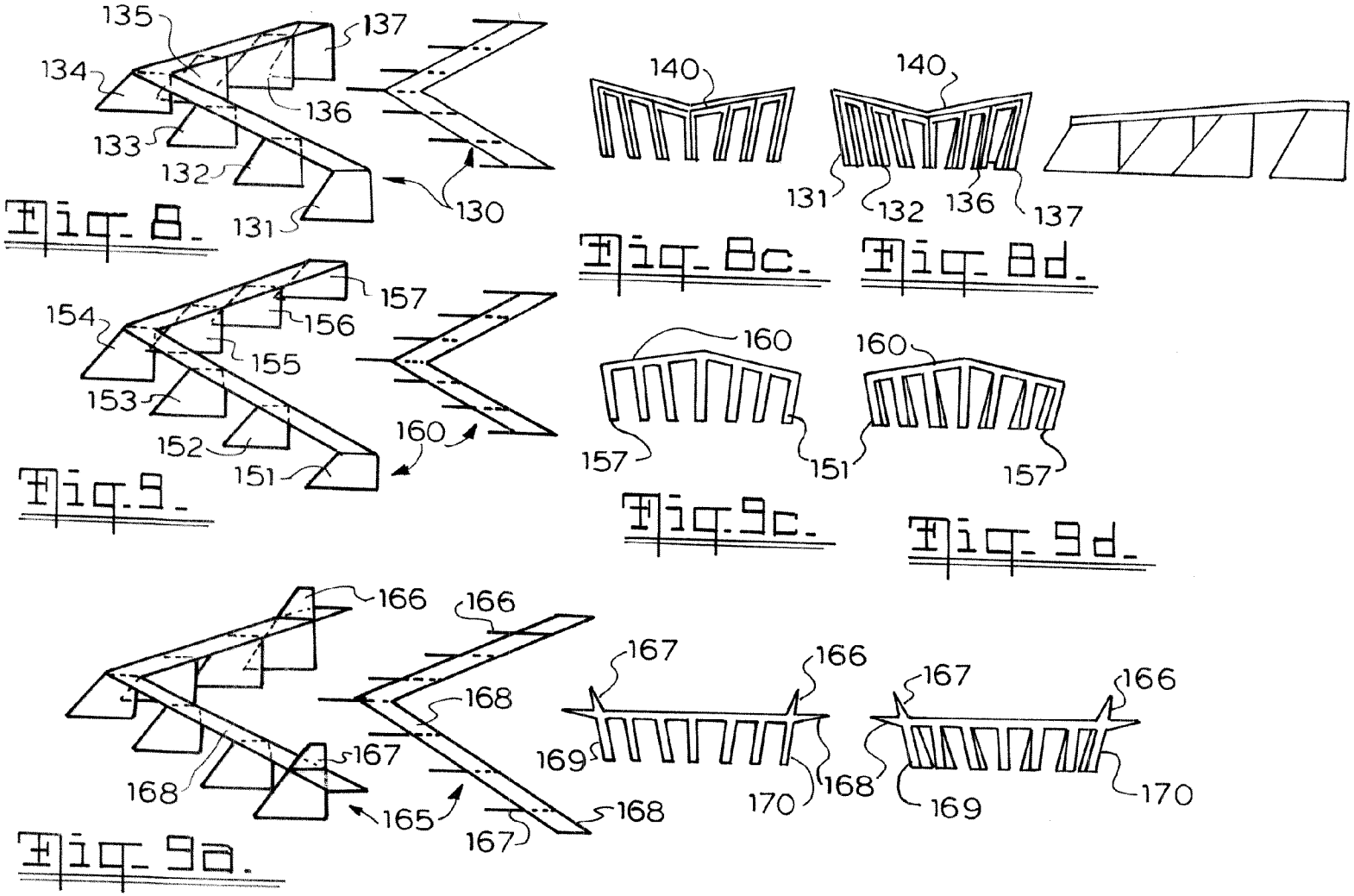

FIG. 8 shows a variation of the invention 130 according to Example 8. In this example, the stabilizer device is shown in the "V" shaped configuration with seven keel members 131–137.

As shown in FIG. 8*c*, the keel members are parallel to the longitudinal axis of the watercraft. This view also shows that the transverse member 140 forms a dihedral angle with the under surface of the watercraft.

FIG. 8*d* shows a rear elevation of the stabilizer device of Example 8 wherein the outermost keel members 131, 132 and 136, 137 are inclined gradually towards the front or nose of the watercraft.

EXAMPLE 9

FIG. 9 shows a preferred embodiment of the invention according to Example 9 wherein the transverse member 160 forms an anhedral angle with the under surface of the watercraft. As with FIG. 8, the elevation shown in FIG. 9*c* shows the keel members 151–157 substantially parallel to the longitudinal axis of the watercraft.

FIG. 9*d* shows the transverse member 160 at an anhedral angle with the under surface of the watercraft and wherein the keel members are inclined towards the front or nose of the watercraft.

FIG. 9A shows another embodiment of the invention 165 wherein one or more of the truly keel members 166–167 is of a greater height than the other keel members and where the transverse member 168 extends past the outermost keel member 169, 170.

Figure 10:
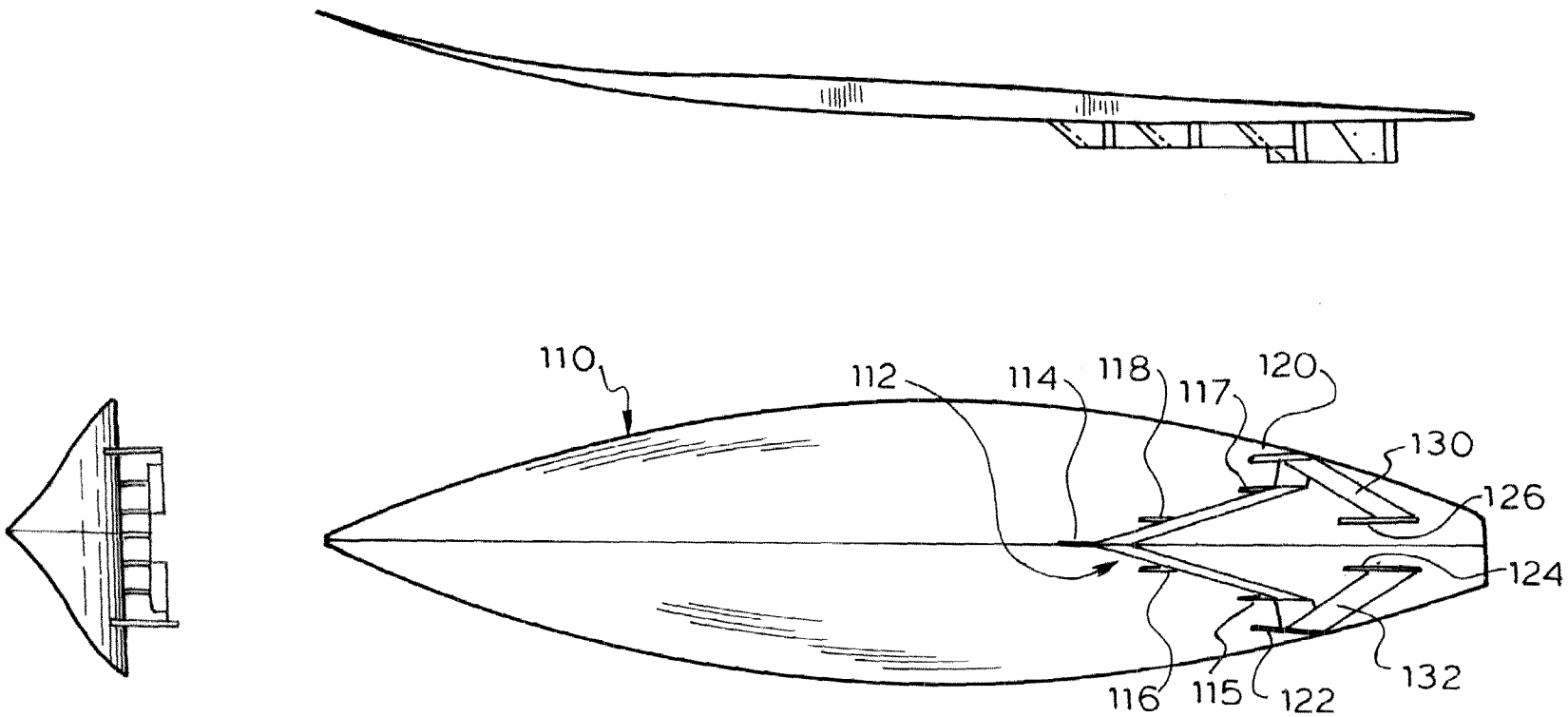

FIG. 10 shows a preferred embodiment of the invention 100 fitted to a surfboard 110 in this example, the stabilizer device has a V shape transverse member 112, joining keel members 114, 115, 116, 117, 118. The rear most keel members 120, 122, 124, 126 are shown joined by transverse members 130, 132.

The last four keel members 120, 122, 124, 126, are also shown elevated at a greater height than those of the leading keel members 114 to 118.

Figure 11:
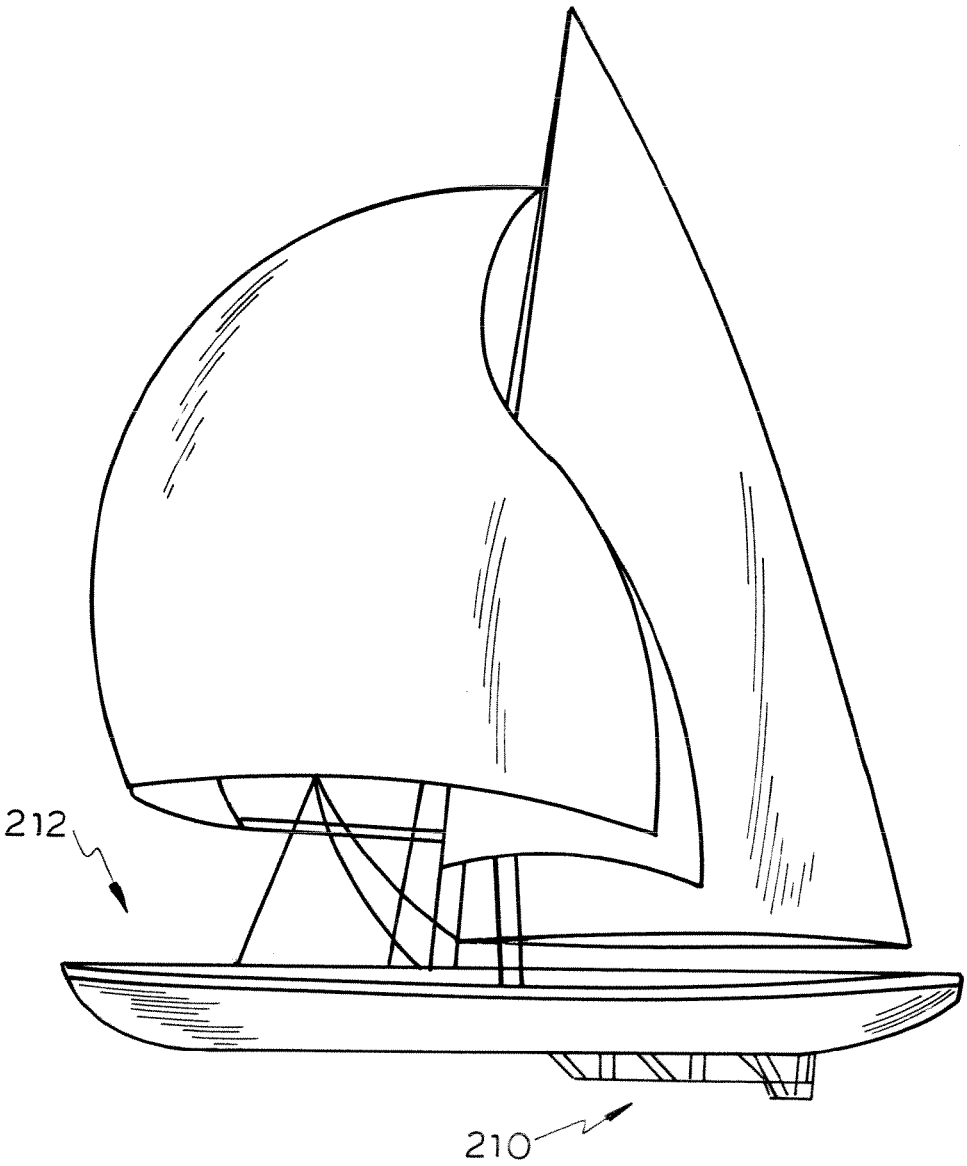

FIG. 11 shows the invention 210 fitted to a Yacht 212. The stabilizer device 210 is preferably constructed of a durable hard, non-corroding material such as marine grade stainless steel or brass. The transverse member joins the keel members. Preferably the leading keel member can be weighted to provide a righting moment to the Yacht when sailing.

Figure 12:
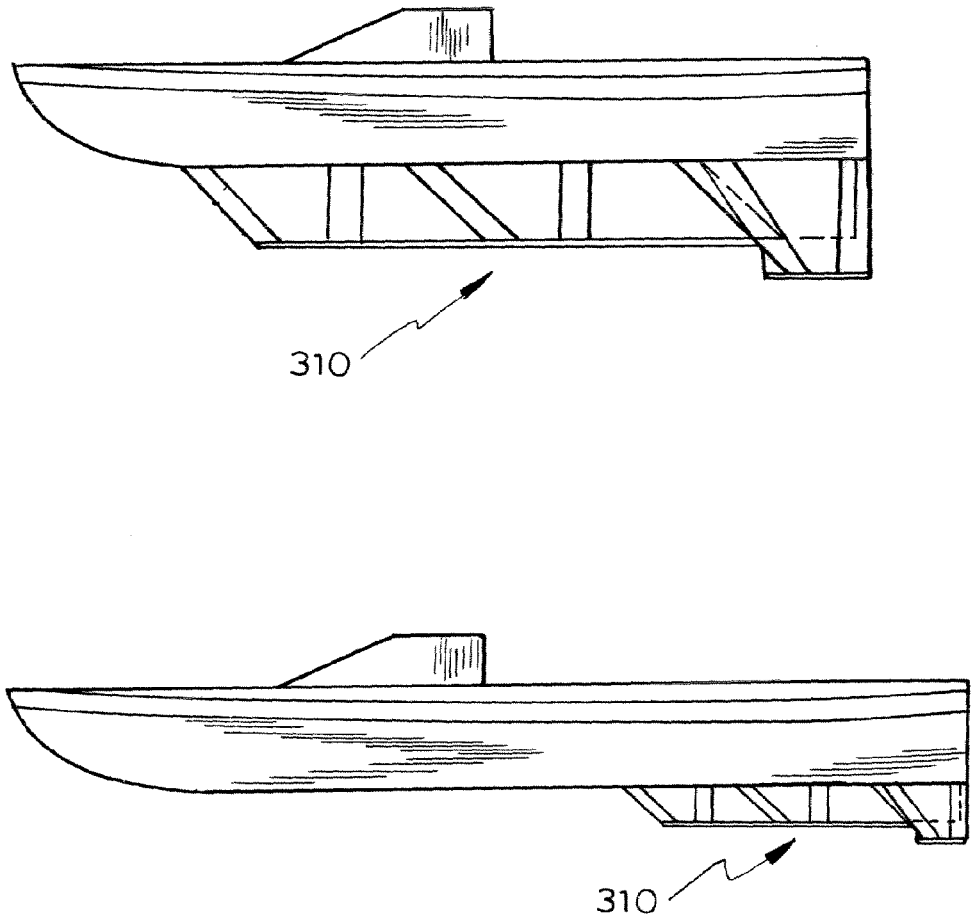

FIG. 12 shows the stabilizer device 310 fitted to a Powerboat. The stabilizer device 310 is also preferably fabricated of a durable, hard, non-corroding marine grade material such as stainless steel or brass. In the alternative, the material can be of a hard molded plastic or plastic coated metal.

Figure 13:
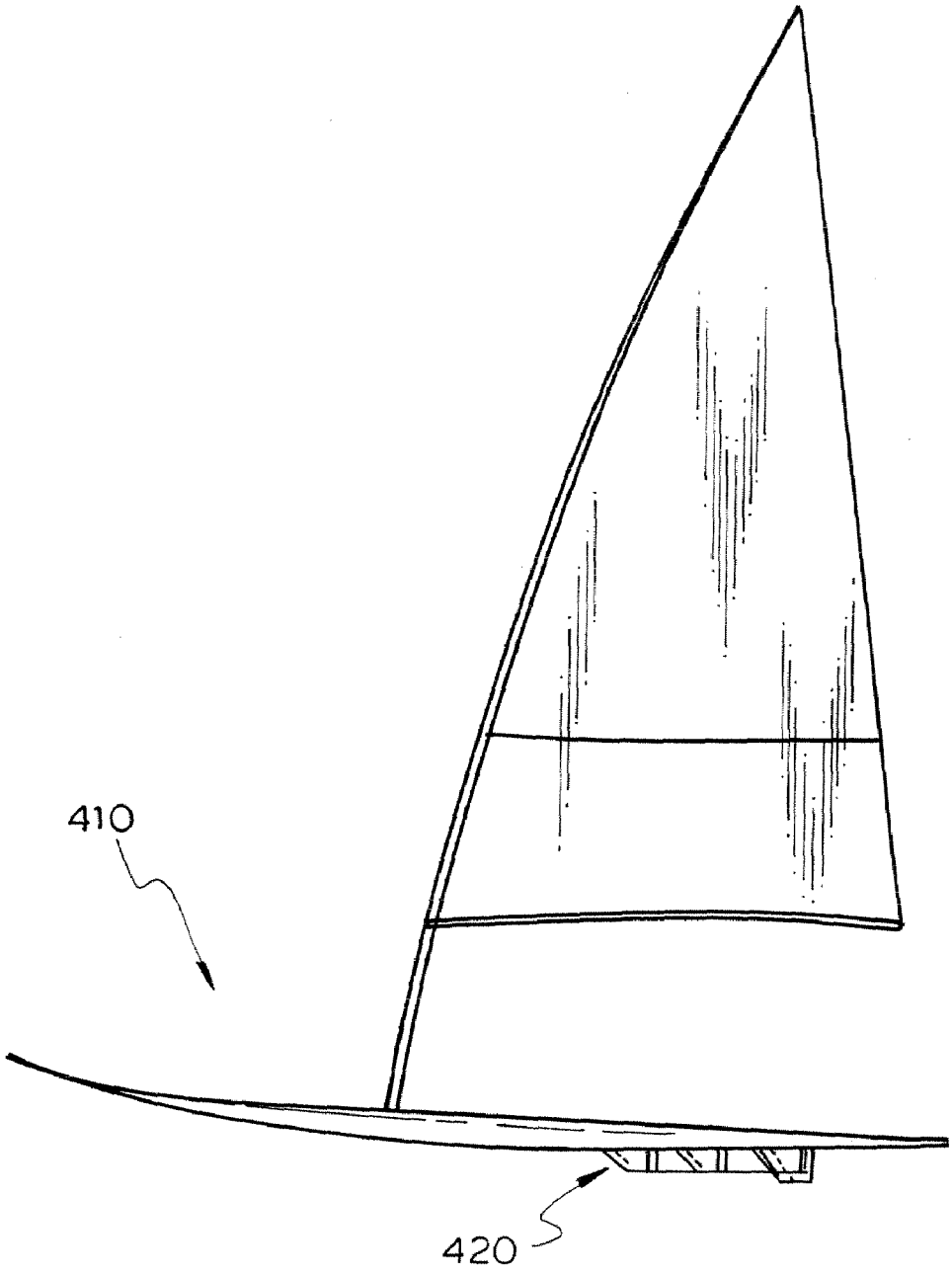

FIG. 13 shows stabilizer device 410 fitted to a Sail board 420.

Figure 14:
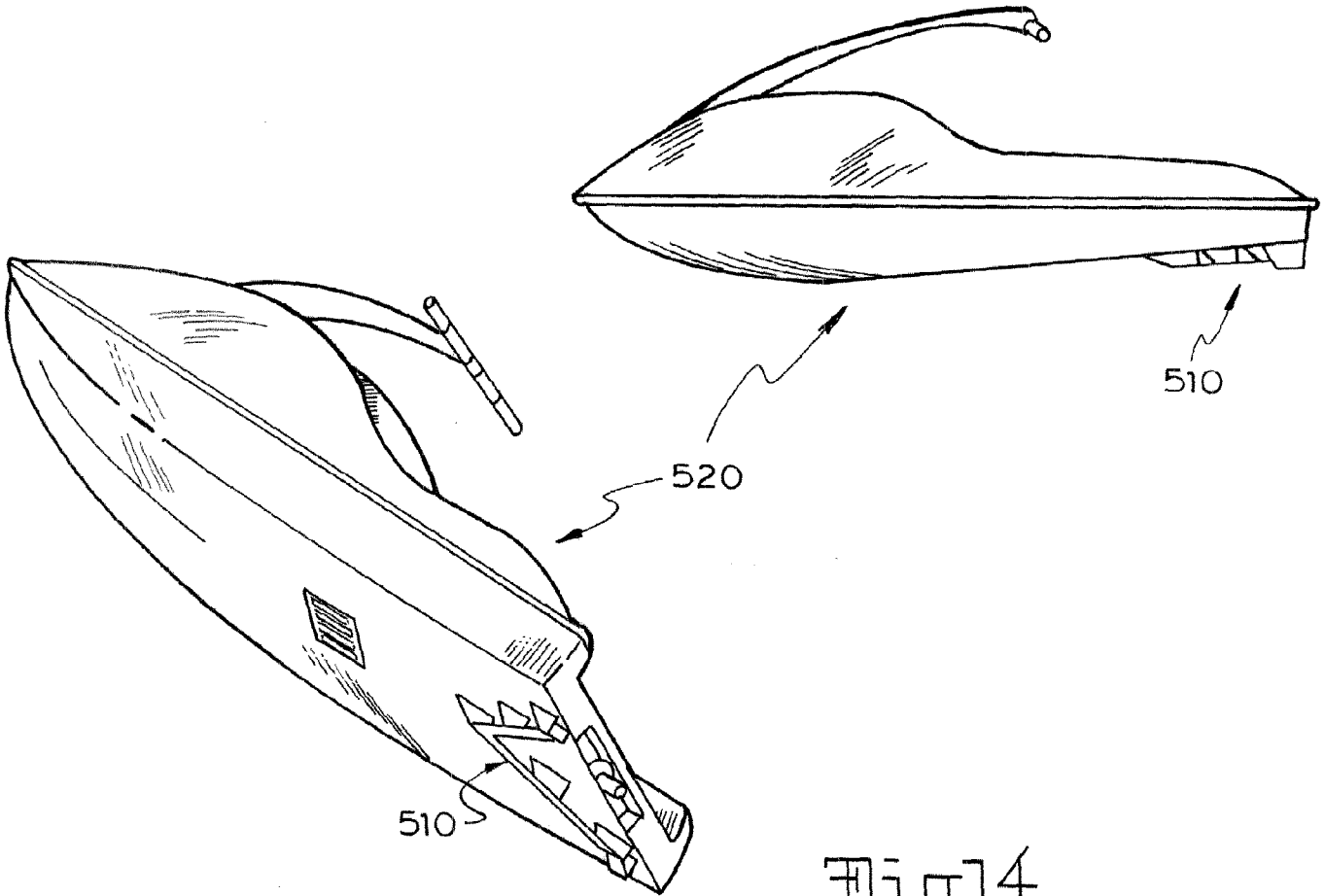

FIG. 14 shows a stabilizer device 510 fitted to a Jetski 520.

Figure 15:
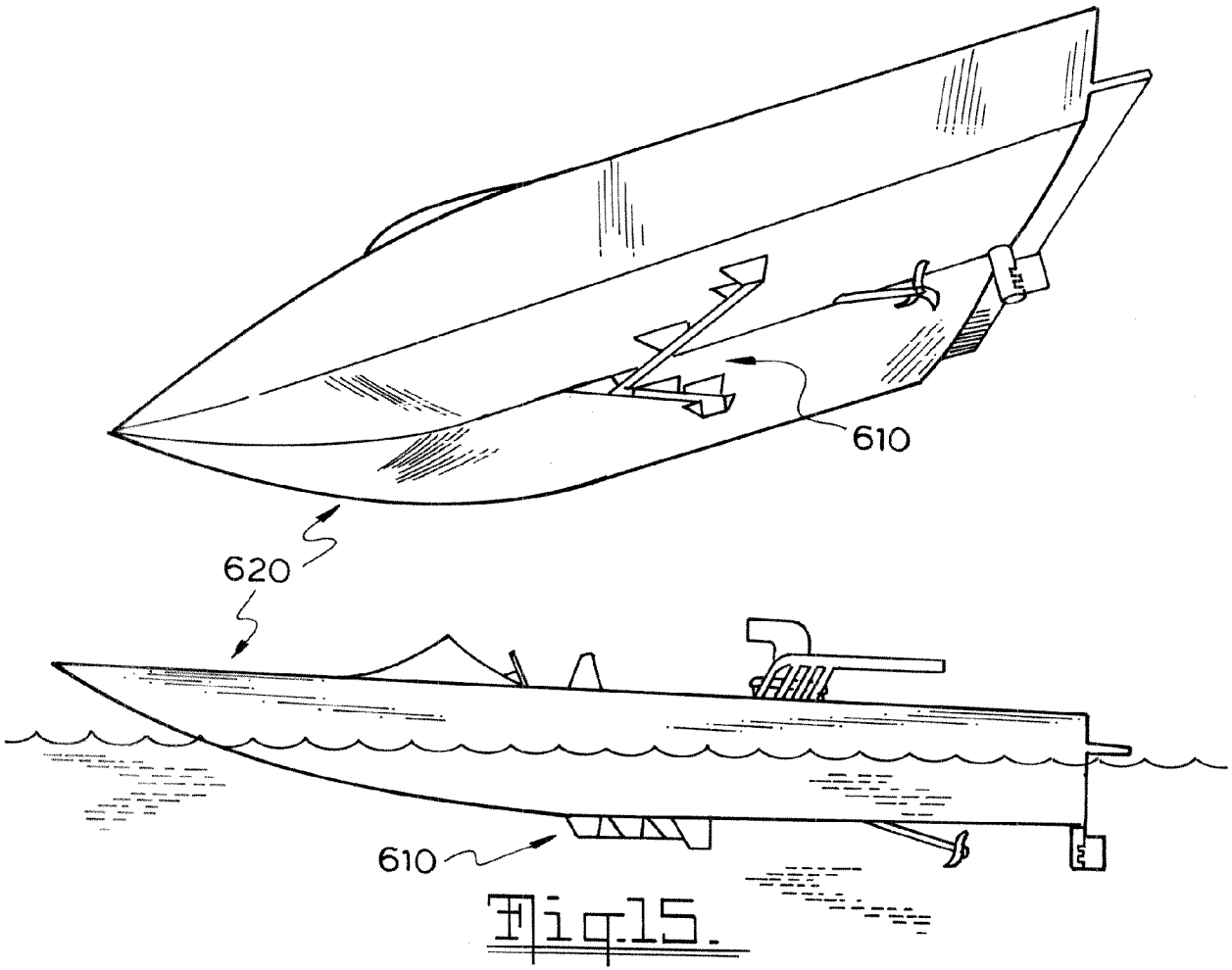

FIG. 15 shows a stabilizer device 610 fitted to a Skiboat 620.

ADVANTAGES

The advantages of the present invention which the inventor has discovered include the following qualities of the stabilizer device:

1. Environmental benefits with the use of recyclable materials such as recyclable plastics.
2. The device is inexpensive to manufacture as it can be manufactured by moulding from recyclable plastic in one piece.
3. The device is also less labour intensive to fit than individual fins to watercraft.
4. The device can be transferable from different surfboards or watercraft to other surfboards or watercraft.
5. The device is lighter than a lot of current fin systems.
6. The device is also better performing i.e. that the surfboards fitted with the stabilizer device are able to turn and accelerate faster than with the current fin systems.
7. The device is safer to surfboard and sailboard riders as the keel members are of a lower aspect ratio than the fins of current fin systems.
8. The stabilizer device is also adjustable with respect to the surfboard or watercraft to which it is fitted.
9. The inclusion of a transverse member greatly reduces the incidences of penetration injuries usually experienced with conventional exposed fin systems.

VARIATIONS

It will of course be realised that while the foregoing has been given by way of illustrative example of this invention, all such and other modifications and variations thereto as would be apparent to persons skilled in the art are deemed to fall within the broad scope and ambit of this invention as is herein set forth.

Throughout the description and claims this specification the word "comprise" and variations of that word such as "comprises" and "comprising", are not intended to exclude other additives, components, integers or steps.

The invention claimed is:

1. A low profile stabilizer device for attaching to the under surface of a watercraft, including in combination a plurality of stubby keel members joined by one or more transverse members spaced from the bottom surface of the watercraft, the keel members comprising a normally vertical foremost keel member positioned along the longitudinal centerline of the watercraft, trailing keel members on either side of the foremost keel member, the trailing keel members leaning in a normal position at an angle from vertical with respect to the foremost keel member and trailing in staggered formation on each side of the centerline outwardly towards the rear and sides of the watercraft, wherein the trailing keel members are longitudinally spaced apart from the vertical foremost keel member when seen in a side elevational view of the stabilizer device, wherein the longitudinally staggered formation is adapted to substantially reduce or remove interference to the sideways release of water from each keel member by an adjacent keel member, and wherein in operation, one or more of the leaning keel members approach a vertical position as the watercraft heels over in a turning maneuver.

2. A stabilizer device as claimed in claim 1 wherein the trailing keel members on either side of the foremost keel member lean away from the foremost keel member.

3. A stabilizer device as claimed in claim 1 wherein the trailing keel members lean toward the foremost keel member.

4. A stabilizer device as claimed in claim 1 wherein the keel members are staggered in a "U", "V" or "W" formation across the under surface of the watercraft.

5. A stabilizer device as claimed in claim 1 wherein all keel members are joined by a single transverse member.

6. A stabilizer device of claim 1 wherein all keel members and transverse members have aerodynamic or hydrodynamic cross sections and function as hydrofoils.

7. A stabilizer device of claim 1 wherein the stubby keel members are foil sections of a low aspect ratio.

8. A stabilizer device of claim 1 wherein the transverse members are foil sections of a high aspect ratio.

9. A stabilizer device of claim 1 wherein the directional stability and hydrodynamic lift imparted by the keel members and by the transverse members contribute to an overall reduction in turbulence and drag of the watercraft moving though water.

10. A stabilizer device of claim 1 wherein the keel members and transverse members are manufactured, in one unitary piece and are adapted to replace the fins on a surfboard or sailboard.

11. A stabilizer device of claim 1 wherein the stabilizer device is molded from a resilient flexible material to reduce injury.

12. A stabilizer device of claim 1 wherein the stabilizer is made of a rigid non-corroding marine grade material.

13. A stabilizer device of claim 1 wherein watercraft fitted with the stabilizer device instead of fins can be maneuvered and controlled in the same manner as if the watercraft were fitted conventional fins.

14. A stabilizer device of claim 1 wherein the transverse members are angled or inclined at a dihedral angle with respect to undersurface of the watercraft.

15. A stabilizer device of claim 1 wherein the transverse members are angled or inclined at an anhedral angle with respect to the under surface of the watercraft.

16. A stabilizer device of claim 1 wherein the transverse members have end tips that are at a different angle to the main portion of the transverse members.

17. A stabilizer device of claim 1 further comprising a plurality of fasteners for attaching the stabilizer to the under surface of a watercraft.

18. A stabilizer device of claim 1 wherein the stabilizer device further includes vertical projection members attached to fin boxes.

19. A stabilizer device of claim 1 wherein the positions of the transverse members and keel members can be individually adjusted with respect to one another and with respect to their location on the under surface of the watercraft.

20. A stabilizer device of claim 1 wherein transverse members and the keel members together with the under surface form one or more channels adapted to channel water along the under surface thereby reducing turbulence and drag.

21. A stabilizer device of claim 1 wherein one or more of the keel members is of greater height than the other keel members and the transverse members extend past the outermost keel members.

22. A low profile stabilizer device for attaching to the under surface of a watercraft, including in combination a plurality of stubby keel members joined by one or more transverse members spaced from the bottom surface of the watercraft, the keel members comprising a normally vertical foremost keel member positioned alone the longitudinal centerline of the watercraft, trailing keel members on either side of the foremost keel member, the trailing keel members leaning in a normal position at an angle from vertical with respect to the foremost keel member and trailing in staggered formation on each side of the centerline outwardly towards the rear and sides of the watercraft, the longitudinally staggered formation adapted to substantially reduce or remove interference to the sideways release of water from each keel member by an adjacent keel member, wherein in operation, one or more of the leaning keel members approach a vertical position as the watercraft heels over in a turning maneuver wherein leading edges of the trailing keel members and the transverse members are slightly inclined towards the or front of the watercraft to provide positive angles attack adapted to induce hydrodynamic lift as the watercraft moves through water.

23. A surfboard fitted with the stabilizer device of claim 1, wherein the surfboard is steerable by altering the weight distribution of the rider on the surfboard thereby altering the angles of attack of both the keel members and the transverse members.

24. A low profile stabilizer device for attaching to the under surface of a watercraft, including in combination a plurality of stubby keel members joined by one or more transverse members spaced from the bottom surface of the watercraft, the keel members comprising a normally vertical foremost keel member positioned along the longitudinal centerline of the watercraft, trailing keel members on either side of the foremost keel member, the trailing keel members leaning in a normal position at an angle from vertical with respect to the foremost keel member and trailing in staggered formation on each side of the centerline outwardly towards the rear and sides of the watercraft, the longitudinally staggered formation adapted to substantially reduce or remove interference to the sideways release of water from each keel member by an adjacent keel member, wherein in operation, one or more of the leaning keel members approach a vertical position as the watercraft heels over in a turning maneuver wherein the transverse members lie in a horizontal plane that is tangential or parallel to the under surface.

25. A low profile stabilizer device for attaching to the under surface of a watercraft, including in combination a plurality of stubby keel members joined by one or more transverse members spaced from the bottom surface of the watercraft, the keel members comprising a normally vertical foremost keel member positioned along the longitudinal centerline of the watercraft, trailing keel members on either side of the foremost keel member, the trailing keel members leaning in a normal position at an angle from vertical with respect to the foremost keel member and trailing in staggered formation on each side of the centerline outwardly towards the rear and sides of the watercraft, the longitudinally staggered formation adapted to substantially reduce or remove interference to the sideways release of water from each keel member by an adjacent keel member, wherein in operation, one or more of the leaning keel members approach a vertical position as the watercraft heels over in a turning maneuver wherein the stabilizer is provided with a plurality of slots for cooperation with fasteners attaching the stabilizer to the underside of a watercraft allowing fore and aft adjustment of the stabilizer position.

* * * * *